US005865685A

United States Patent [19]

Thomas

[11] Patent Number: 5,865,685

[45] Date of Patent: Feb. 2, 1999

[54] GOLF SWING IMPROVEMENT DEVICE

[76] Inventor: Joseph G. Thomas, 1905 Castalia Dr., Cary, N.C. 27513

[21] Appl. No.: 75,708

[22] Filed: May 11, 1998

[51] Int. Cl.[6] ..... A63B 69/36

[52] U.S. Cl. ..... 473/213; 473/229; 473/276

[58] Field of Search ..... 473/205, 206, 473/213, 276, 229

[56] References Cited

U.S. PATENT DOCUMENTS

D. 271,319 11/1983 Barty, Jr. .
D. 280,121 8/1985 Klein .
D. 306,335 2/1990 Franey .
D. 308,998 7/1990 Cates .
D. 329,678 9/1992 Mehrholz .
D. 354,327 1/1995 Harkins, Jr. .
D. 356,135 3/1995 Slusher .
D. 361,613 8/1995 Thomas .
D. 372,064 7/1996 del Barrio .
5,174,575 12/1992 Leith et al. ..... 473/213
5,413,329 5/1995 Hirsch .

*Primary Examiner*—George J. Marlo
*Attorney, Agent, or Firm*—Lynn E. Barber

[57] ABSTRACT

A golf swing improvement device that includes two adjustable wrist encircling members, a golf club gripping member capable of fitting on any golf club, and a stretchable, flexible linear portion having two end areas. One of the end areas is attached to one of the wrist encircling members and the other end area is attached to the other wrist encircling member. A central area of the linear portion is firmly held by the golf club gripping member so that the length of linear portion extending between each wrist encircling member and the golf club gripping member may be separately adjusted in length.

7 Claims, 3 Drawing Sheets

GOLF SWING IMPROVEMENT DEVICE

BACKGROUND OF THE INVENTION

1. Field of the Invention

This invention relates to devices for improving a golfer's game, and in particular, relates to a golf swing improvement device.

2. Description of the Related Art

The difficulty of achieving a proper golf club swing has been addressed by numerous types of inventions, related to such various components of swing as the golfer's hand position, angle of golf club, follow-through of the swing, and the like. For example, there are various hand positioning guides including those of Carlisle (U.S. design Pat. No. D361,613) and Harkins, Jr. (U.S. design Pat. No. D354,327).

The golf club alignment guide of Hirsch (U.S. Pat. No. 5,413,329) is a detachable stand for supporting a golf club that includes a triangular-shaped bracket member pivotally supporting a spring clamp adapted to clamp the shaft of a golf club so that the golf club is supported in an upright position at an angle selected by player.

The golf club swing training device of Huber (U.S. Pat. No. 4,664,388) comprises a ball suspended by a cord from a handle or from the shaft of a golf club for use in a set of drill steps intended to teach a proper golf swing, through utilization of the centrifugal forces required in a proper golf swing.

The golf swing training aid of Slusher (U.S. design Pat. No. D356135) appears to include a hand-piece clampingly mounted parallel to a golf club handle so the person holds two separate handles during the training.

The golf swing control strap of del Barrio (U.S. design Pat. No. D372,064) include a buckled strap apparently for encircling an arm, attached perpendicularly to a buckled vertical strap that is attached to a small curved piece, presumably for encircling a golf club handle.

None of the known inventions provide a means for flexibly positioning both of the golfer's hands to assist the golfer in keeping the hands in correct position with correct follow-through in the swing. It is therefore an object of the invention to provide a device which gives a user the correct positioning of hands and wrists, and thus allows improvement of the accuracy of the person's game.

Other objects and advantages will be more fully apparent from the following disclosure and appended claims.

SUMMARY OF THE INVENTION

The invention herein is a golf swing improvement device that includes two adjustable wrist encircling members, a golf club gripping member capable of fitting on any golf club, and a stretchable, flexible linear portion having two end areas. One of the end areas is attached to one of the wrist encircling members and the other end area is attached to the other wrist encircling member. A central area of the linear portion is firmly held by the golf club gripping member so that the length of linear portion extending between each wrist encircling member and the golf club gripping member may be separately adjusted in length.

Other objects and features of the inventions will be more fully apparent from the following disclosure and appended claims.

DETAILED DESCRIPTION OF THE INVENTION AND PREFERRED EMBODIMENTS THEREOF

Figure 1:
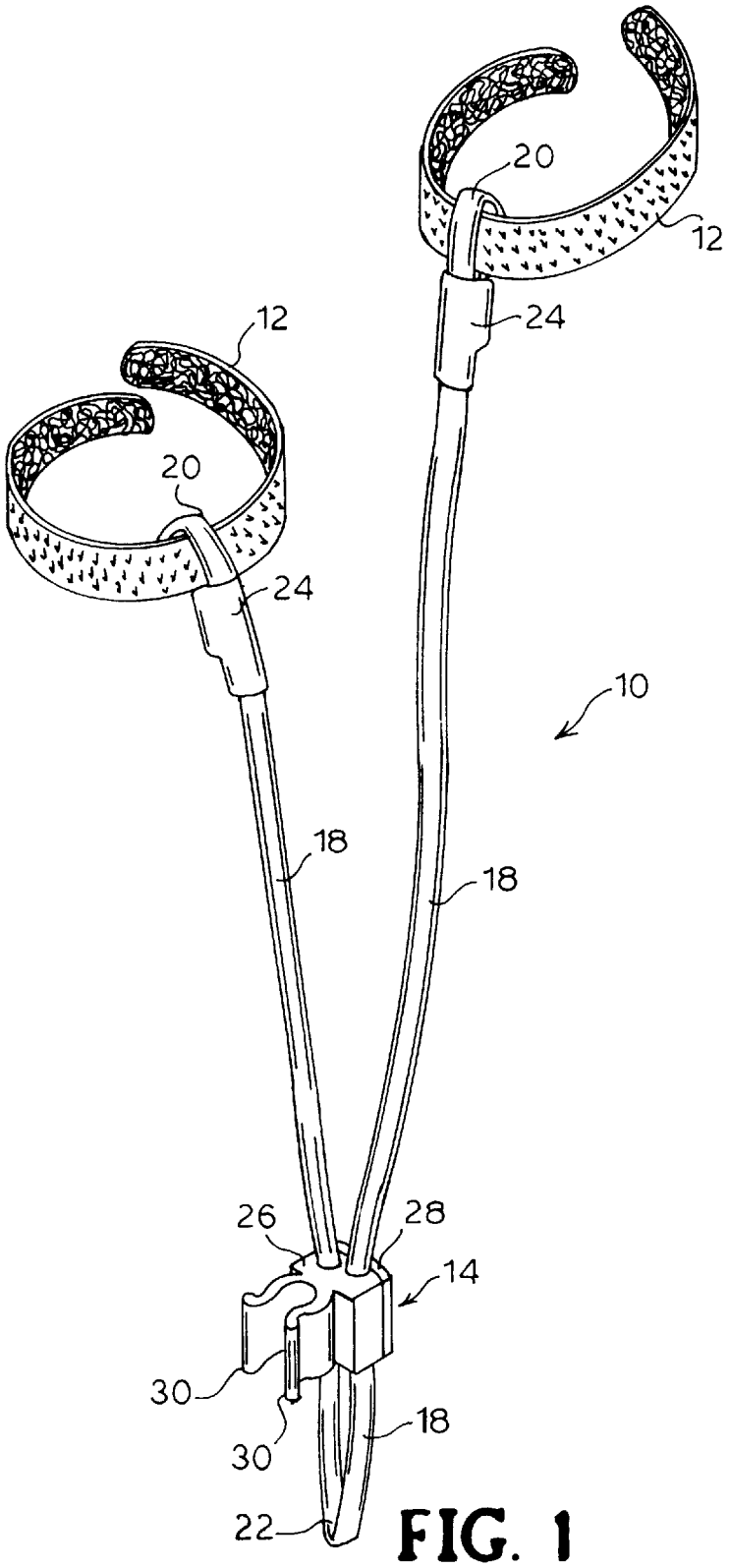
FIG. 1 is a perspective view of a golf swing improvement device according the invention herein.

Referring now to the Figures, the present invention is for golf swing improvement device 10 (FIG. 1), comprising two adjustable wrist encircling members 12; a golf club gripping member 14 capable of fitting on any golf club 16 (FIG. 3); and a stretchable, flexible linear portion 18 having two end areas 20 which are preferably identical (FIG. 1). One of the end areas 20 is slidingly attached to one of the wrist encircling portions 12 and the other end area 20 is slidingly attached to the other wrist encircling member 12. A central area 22 of the linear portion 18 is firmly held by the golf club gripping member 14 so that the length of linear portion 18 extending between each wrist encircling member 12 and the golf club gripping member 14 may be separately adjusted.

Preferably the wrist encircling members 12 are made of a loop and hook self-fastening material, such as VELCRO™ to allow for easy use.

The stretchable flexible linear portion 18 preferably is made of a hollow piece of tubing, for example, ¼–1/2-inch (OD) green plastic tubing. Alternatively, the linear portion may be made of other stretchable flexible substances such as appropriate types of rope, mesh, rubber bands, or graphite.

To attach the flexible linear portion 18 to the wrist encircling member 12, preferably each end area 20 of the flexible linear portion 18 is fastened around, one of the two wrist encircling members 12 as shown in FIG. 1. The end area 20 of the flexible linear portion is fastened in position, for example by tape 24 wrapped around the end area 20 as shown in FIG. 1, forming a closed loop of the flexible linear portion 18 through which the wrist encircling member 12 may be pulled for position adjustment.

Figure 3:
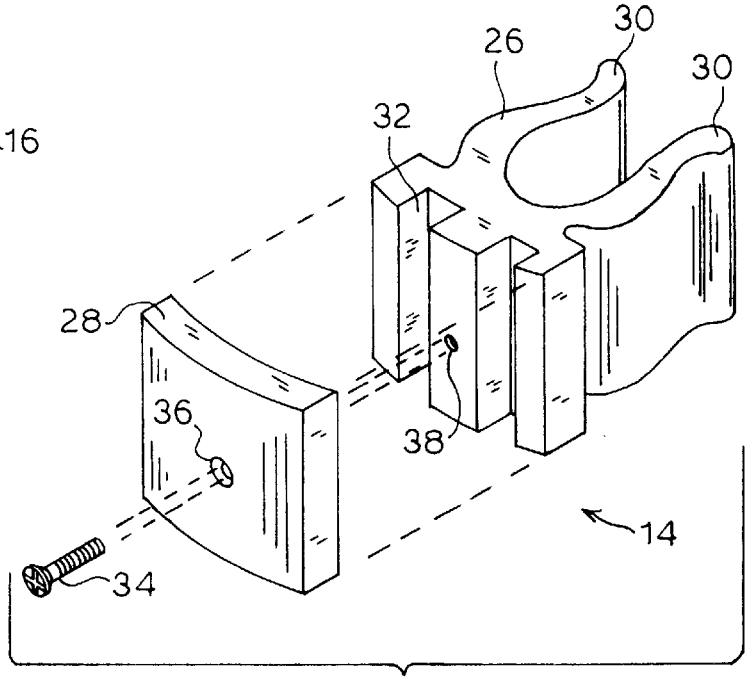
FIG. 3 is an exploded perspective view of the golf club gripping member of FIG. 2.
Figure 4:
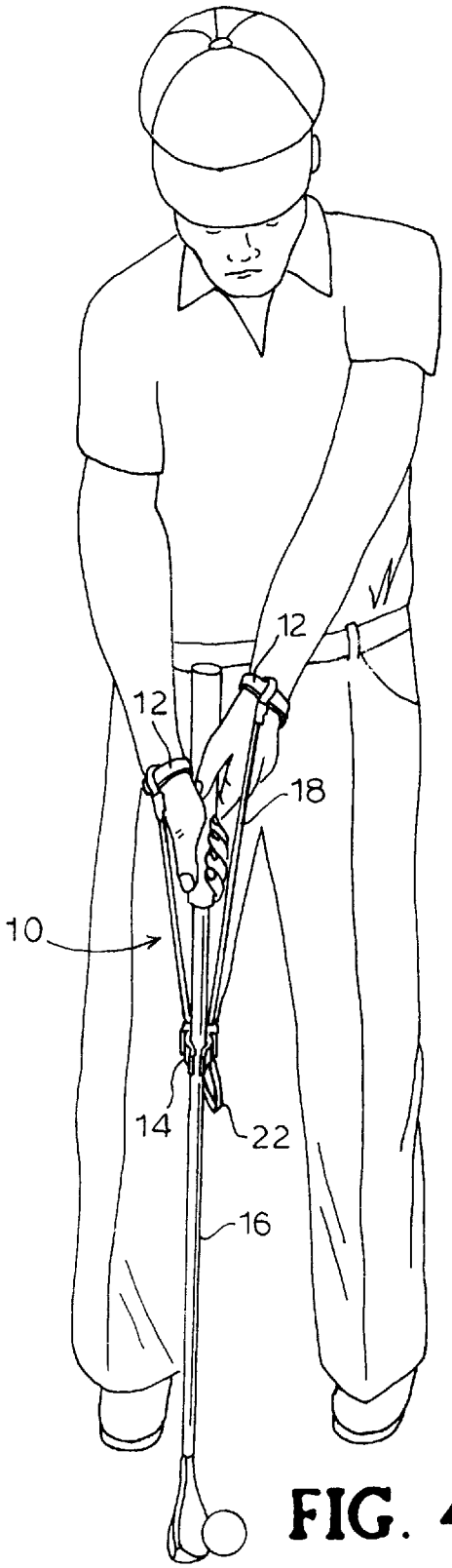
FIG. 4 is a perspective view of a golfer using the golf swing improvement device of the invention.

For ease of assembly, the golf club gripping member 14 preferably comprises a first piece 26 firmly attached to a second piece 28, which together have the dual function of gripping the golf club handle and holding the central area 22 of the linear portion 18 firmly but movably. In the preferred embodiment of the golf club gripping member 14, the first piece 26 has a pair of gripping segments 30 on one side, and two open bores 32 on a second side opposite the first side (FIG. 3). The two bores could alternatively be formed in the second piece 28. In one example of how the gripping member 14 of the invention may be made, the opening between the gripping segments 30 of a preferred plastic gripping member 14 is 0.836" wide at its narrowest and opens to about a 0.454" diameter circular width to hold the golf club handle. The second piece 28 is a generally planar, preferably slightly curved, piece that may be tightly and closely held to the second piece to form a single unit as shown in FIG. 1 and FIG. 3.

Figure 2:
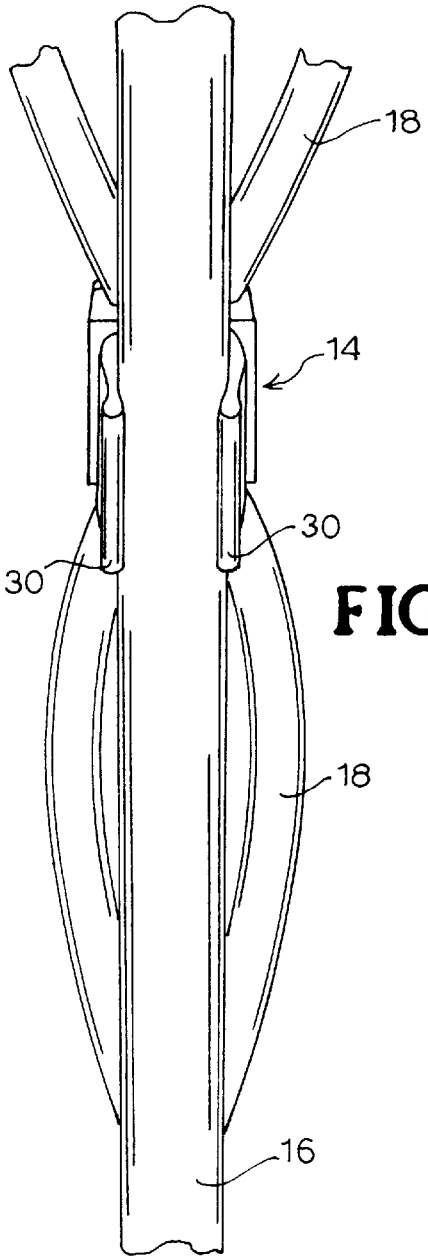
FIG. 2 is an elevational view of a portion of a golf club handle to which the golf club gripping member of the device is attached.

To assemble the flexible linear portion 18 in the gripping member 14, the central area 22 of the flexible linear portion 18 is placed in the two open bores 32 so that a loop of flexible linear portion 18 is formed below the gripping member as shown in FIGS. 1 and 2 and the end areas 20 of the linear portion 18 extend upward out of the gripping member 14. The first piece 26 of the gripping member 14 is then attached to the second piece 28 to close the open bores 32 and firmly hold the flexible linear portion 18 in the gripping member 14. The means of attachment of the two pieces is preferably a releasable means, such as a screw 34 placed through a threaded hole 36 extending through the second piece 28 into a terminated hole 38 extending partway into the first piece 26 (FIG. 3). Due to the compressibility of the flexible linear portion 18 and the size of the bores 32, which are generally smaller in diameter than the outer diameter of the uncompressed linear portion 18, the flexible linear portion 18 is held tightly in the bores 32 and does not easily or accidentally slip through or from the gripping member 14. It may, however, be gradually changed in position in the gripping member 14 by pulling along the axis of the linear portion 18.

The golf club gripping member 14 is preferably made of a molded or cut flexible plastic which holds its shape sufficiently to grip the golf club 16, but is sufficiently resiliently deformable to allow the gripping segments 30 to be pushed over a golf club handle. The gripping member 14 may also be made of hard rubber, graphite, wood, metal, or aluminum. If the material is inflexible, it is important to be sure that there is a gap between the gripping segments which is sufficiently wide to slip over the narrower portion of a golf club handle without difficulty.

Use of the device of the invention is easily accomplished. Because most golf club handles are wider near the top and narrower at the bottom, the gripping elements of the first portion are pushed over the lower area of the golf club handle where the handle is thinner, and then slid upward until the gripping member 14 it stops in a firm position because of the increased width of the golf club handle. The wrist encircling members 12 are positioned around the user's wrist with the end areas 20 facing upward (over the back of the hand). The length of the linear portion 18 length between each of the the user's hands and the gripping member 14 is checked to see if it provides a comfortable fit with a slight amount of resistance on each of the wrists. If the pull on the wrist encircling member 12 is too tight or too loose, the length of the linear portion 18 between the gripping member 14 and either or both wrist encircling members 12 may be adjusted by pulling on the relevant linear portion 18 in the appropriate direction so that the linear portion 18 is moved the correct amount through the bores 32. The resistance is of value to give the golf user the correct tension that is needed to complete the correct swing time after time. Optimizing the resistance to obtain the best golfing swing, and then practicing golfing with the device of the invention adjusted in this optimum amount will give the golfer the feel of the correct swing motion in which wrist and hand control resistance is most important.

Once the device is adjusted for a particular user and golf club, the device can easily be transferred to another golf club, generally without readjustment so that the golfer can practice golf swings with more than one club.

The golf swing improvement device is designed to develop and maintain the most accurate positioning of the hand wrist, whether the ball is being hit at a practice range or at any other type of practicing. Correct positioning of the hands and wrists with using the device of the invention aids in driving the golf ball farther and straighter, allows chipping and putting the ball better, improves accuracy, and most importantly helps develop and maintain muscle memory so that the golfer who has practiced with the device can improve later performance even when the device is not being used. Routine practice with the device of the invention can thus improve confidence, which also improves performance.

The golf swing improvement device has the further advantages that it can be used by left- or right-handed players, and can be used by any level of player. The separate adjustability of the length of the linear portion between the golf club gripping member and the wrist encircling members allows accurate positioning of each hand and wrist which is vital to a correct golf swing.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A golf swing improvement device, comprising:

(a) two adjustable members, one adjustable member being positionable around a golfer's right wrist and the other adjustable member being positionable around the golfer's left wrist;

(b) a gripping member attachable to a golf club handle by placing over a narrower lower area of the handle and sliding upwards to a firm position on the golf club handle; and (c) a stretchable, flexible linear portion having:

(i) a first end area slidingly attached to one adjustable member and a second end area slidingly attached to the other adjustable member; and (ii) a central area firmly held by said gripping member, wherein the length of the linear portion extending between each said adjustable member and the gripping member may be separately adjusted by changing the position of the linear portion in the gripping member.

2. The golf swing improvement device according to claim 1, wherein the adjustable members are made of a loop and hook self-fastening material.

3. The golf swing improvement device according to claim 1, wherein the gripping member is made of a flexible plastic.

4. The golf swing improvement device according to claim 1, wherein the gripping member comprises a first piece having a pair of gripping segments and two bores for insertion of the stretchable, flexible linear portion.

5. The golf swing improvement device according to claim 1, wherein the stretchable flexible linear portion comprises a hollow piece of tubing.

6. The golf swing improvement device according to claim 5, wherein each end area of the tubing encircles, and is fastened around, one of the adjustable members.

7. The golf swing improvement device according to claim 1, wherein the adjustable members are made of a loop and hook self-fastening material, the gripping member comprises a first piece and a second piece, said first piece having a pair of gripping segments for placement around a golf club handle and two bores for insertion of the stretchable, flexible linear portion, said first piece attached to said second piece to close the bores, and wherein the stretchable flexible linear portion comprises a hollow piece of tubing with each end area of the tubing encircling, and being fastened around, an adjustable member.

* * * * *